US006247445B1

(12) United States Patent
Langer

(10) Patent No.: US 6,247,445 B1
(45) Date of Patent: Jun. 19, 2001

(54) METHOD FOR OPERATING AN INTERNAL COMBUSTION ENGINE, IN PARTICULAR FOR A MOTOR VEHICLE

(75) Inventor: Winfried Langer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/254,582

(22) PCT Filed: Jul. 1, 1998

(86) PCT No.: PCT/DE98/01809

§ 371 Date: Mar. 5, 1999

§ 102(e) Date: Mar. 5, 1999

(87) PCT Pub. No.: WO99/02836

PCT Pub. Date: Jan. 21, 1999

(30) Foreign Application Priority Data

Jul. 8, 1997 (DE) ..... 197 29 100

(51) Int. Cl.[7] ..... F02D 41/22; F02D 41/40

(52) U.S. Cl. ..... 123/305; 123/295; 123/350; 701/107

(58) Field of Search ..... 123/295, 305, 123/350, 690, 479; 701/107, 114; 73/119 A

(56) References Cited

U.S. PATENT DOCUMENTS

| | | | | |
|---|---|---|---|---|
| 5,186,081 | | 2/1993 | Richardson et al. | 477/33 |
| 5,692,472 | * | 12/1997 | Bederna et al. | 123/350 |
| 5,755,198 | * | 5/1998 | Grob et al. | 123/295 |
| 5,964,200 | * | 10/1999 | Shimada et al. | 123/305 |

FOREIGN PATENT DOCUMENTS

| | | |
|---|---|---|
| 0 538 890 | 4/1993 | (EP) . |
| 2 739 331 | 4/1997 | (FR) . |
| 7-119522 | 5/1995 | (JP) . |

* cited by examiner

*Primary Examiner*—Andrew M. Dolinar
(74) *Attorney, Agent, or Firm*—Kenyon & Kenyon

(57) ABSTRACT

A method for operating an internal combustion engine, in particular of a motor vehicle, in which fuel is injected either in a first operating mode during a compression phase, or in a second operating mode during an intake phase, directly into a combustion chamber. In both operating modes, the fuel mass injected into the combustion chamber is controlled and/or regulated as a function, among other things, of a calculated reference torque to be delivered by the internal combustion engine. A true torque delivered by the internal combustion engine and a permissible torque are determined; and the true torque is compared to the permissible torque.

32 Claims, 2 Drawing Sheets

METHOD FOR OPERATING AN INTERNAL COMBUSTION ENGINE, IN PARTICULAR FOR A MOTOR VEHICLE

FIELD OF THE INVENTION

The present invention relates to a method for operating an internal combustion engine, in particular of a motor vehicle, in which fuel is injected either in a first operating mode during a compression phase, or in a second operating mode during an intake phase, directly into a combustion chamber. In both operating modes, the fuel mass injected into the combustion chamber is controlled and/or regulated as a function, among other things, of a calculated reference torque to be delivered by the internal combustion engine. The present invention also relates to an internal combustion engine, in particular for a motor vehicle, having an injection valve with which fuel can be injected either in a first operating mode during a compression phase, or in a second operating mode during an intake phase, directly into a combustion chamber. The internal combustion engine includes a control device for controlling and/or regulating the fuel mass injected into the combustion chamber in the two operating modes, as a function, inter alia, of a calculated reference torque to be delivered by the internal combustion engine.

BACKGROUND INFORMATION

Conventional systems for a direct injection of fuel into the combustion chamber of an internal combustion engine are commonly known. A distinction is made in this context between "stratified" mode as a first operating mode, and "homogeneous" mode as a second operating mode. Stratified mode is used in particular at lower loads, while homogeneous mode is utilized when larger loads are present at the internal combustion engine. In stratified mode, the fuel is injected during the compression phase of the internal combustion engine into the combustion chamber, specifically into the immediate vicinity of a spark plug therein. The result is that uniform distribution of the fuel in the combustion chamber can no longer occur. The advantage of stratified mode is that the smaller loads that are present can be handled by the internal combustion engine with a very small fuel mass. Stratified mode is not sufficient, however, for greater loads. In the homogeneous mode provided for such greater loads, the fuel is injected during the intake phase of the internal combustion engine, so that turbulent flow and thus distribution of the fuel in the combustion chamber can still readily occur. To this extent, homogeneous mode corresponds approximately to the operation of internal combustion engines in which fuel is injected conventionally into the intake duct.

In both operating modes, i.e. in stratified and in homogeneous mode, the fuel mass to be injected is controlled and/or regulated by a control device, as a function of a plurality of input variables, to a value that is optimal in terms of fuel economy, emissions reduction, and the like. This control and/or regulation depends, among other things, on a reference torque that is calculated by the control device. The reference torque represents the total torque to be delivered by the internal combustion engine, i.e. the torque which the internal combustion engine is intended to generate. This reference torque is made up, among other things, of the torque requested by the driver and optionally of other torque requirements, for example of a climate-control system or the like. The torque requested by the driver is derived from the position of the accelerator pedal actuated by the driver.

It is possible, however, that a fault may occur in the calculation, by the control device, of the reference torque from the aforesaid input variables. This may involve a fault of a sensor and/or of the control device and/or the like. In particular, it may involve a software fault in the control device which, because the fault occurs infrequently, has not hitherto been detected.

It is the object of the present invention to create a method with which a fault in the calculation of the reference torque can be detected.

SUMMARY OF THE INVENTION

According to the present invention this object is achieved, in a method and in an internal combustion engine, in that a true torque delivered by the internal combustion engine and a permissible torque are determined; and the true torque is compared to the permissible torque.

In other words, a comparison is made between the delivered true torque as determined, and a permissible torque as determined. The true torque and the permissible torque are independent of the (possibly erroneously calculated) reference torque. For this reason, a fault in the reference torque cannot affect the aforesaid comparison. A decision is then made as a function of the comparison as to whether or not the reference torque is erroneous.

The method according to the present invention thus makes it possible to check or monitor the reference torque calculated by the control device. It is possible to ascertain, by way of the comparison, whether the reference torque has been correctly or erroneously calculated by the control device. This check, and the detection thereby achievable of a fault in the calculation of the reference torque, can prevent a resulting erroneous injection of fuel into the combustion chambers of the internal combustion engine. This directly contributes to fuel economy and emissions reduction, and in general to better operation of the internal combustion engine.

It is also advantageous if a particular function is started if the true torque is greater than the permissible torque. The permissible torque thus represents a maximum value which must not be exceeded by the true torque per se. If, however, the true torque is greater than the aforesaid maximum value, the special function then, for example, starts a fault routine or the like which either causes the control device to attempt to correct the fault by way of corresponding corrections, or makes the driver or a mechanic aware of the fault.

In an another embodiment of the present invention, the true torque is determined from the combusted fuel mass. This makes possible a very accurate calculation of the true torque. The combusted fuel mass can be derived, for example, from the signals activating the injection valves, or can be determined by way of other operating parameters of the internal combustion engine.

In another embodiment of the present invention, the true torque is determined from the combusted oxygen mass. In this fashion too, it is possible to calculate the true torque very accurately. From the combusted oxygen mass that is then available, conclusions can then be drawn as to the combusted fuel mass and thus in turn as to the true torque.

In another embodiment of the present invention, the combusted oxygen mass is determined from the infed fresh air and the oxygen remaining in the exhaust gas. In particular, the difference is determined between the oxygen content of the infed fresh air and the oxygen mass remaining in the exhaust gas. This represents a simple yet very accurate and effective way of calculating the combusted oxygen mass and thus ultimately the true torque of the internal combustion engine.

It is advantageous if the fresh air is measured by an air mass sensor, and the oxygen remaining in the exhaust gas by a lambda sensor. The air mass sensor and lambda sensor are usually already provided on the internal combustion engine for other purposes, so that to that extent no additional components are necessary in order to check or monitor the reference torque as defined by the present invention.

In another embodiment of the present invention, exhaust gas recirculation is taken into consideration in determining the combusted oxygen mass. In other words, consideration is given to the fact that the exhaust gas fed into to the combustion chambers by recirculation has a lower oxygen content than the fresh air fed directly into the combustion chambers; and that because of the recirculated exhaust gas, the proportion of infed fresh air is lower. This in turn offers the advantage that the tolerance of the air mass sensor measuring the infed fresh air also plays a lesser role.

In another embodiment of the present invention, the permissible torque is determined from a torque demanded in particular by a driver, and/or from a rotation speed of the internal combustion engine. This represents a simple yet nevertheless accurate and effective way of calculating the permissible torque. In particular, it is possible in this fashion to calculate a maximum value as a function of the torque requested by the driver, in such a way that if the actual value delivered by the internal combustion engine exceeds that maximum value, this indicates a fault in the reference value calculated by the control device.

It is advantageous if the demanded torque is measured by an accelerator pedal sensor, and the rotation speed by a rotation speed sensor. The accelerator pedal sensor and rotation speed sensor are already provided on the internal combustion engine for other purposes, so that to that extent no additional components are necessary in order to check or monitor the reference value in accordance with the present invention.

An implementation of the method according to the present invention is the one in the form of an electrical storage medium that is provided for a control device of an internal combustion engine, in particular of a motor vehicle. What is stored on the electrical storage medium is a program that is capable of running on a calculation device, in particular on a microprocessor, and is suitable for carrying out the method according to the present invention. In this case the present invention is therefore carried out by way of a program stored on an electrical storage medium, so that this storage medium equipped with the program represents the invention in the same fashion as the method for whose execution the program is suitable.

DETAILED DESCRIPTION

Figure 1:
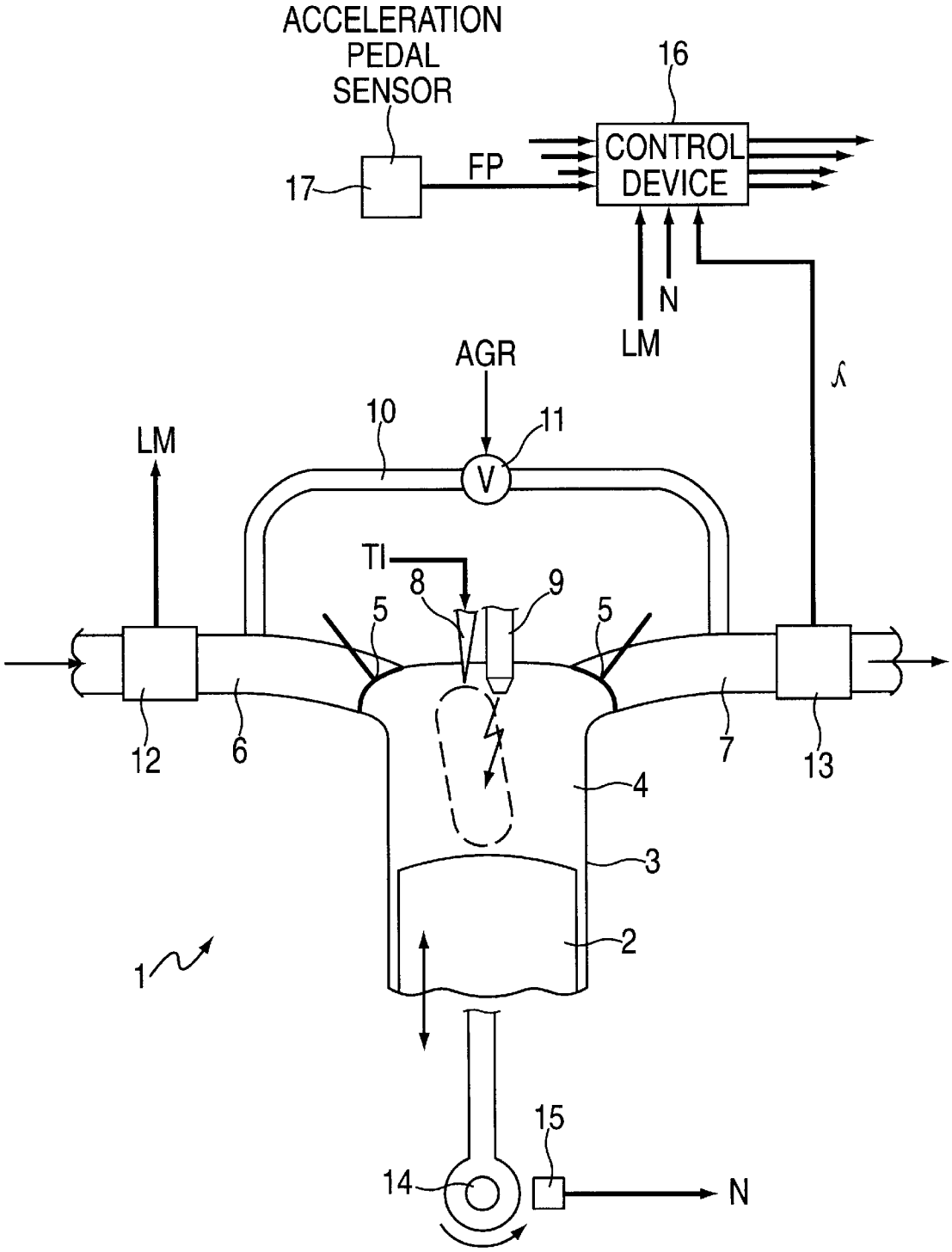
FIG. 1 shows a schematic block diagram of an exemplary embodiment of an internal combustion engine of a motor vehicle according to the present invention.

FIG. 1 depicts an internal combustion engine 1 in which a piston 2 can move back and forth in a cylinder 3. Cylinder 3 is equipped with a combustion chamber 4 to which an intake duct 6 and an exhaust duct 7 are connected via valves 5. Also associated with combustion chamber 4 is an injection valve 8 activatable with a signal TI, and a spark plug 9. Exhaust duct 7 is connected to intake duct 6 via an exhaust gas recirculation line 10 and an exhaust gas recirculation valve 11 controllable with a signal AGR.

Intake duct 6 is equipped with an air mass sensor 12, and exhaust duct 7 with a lambda sensor 13. The air mass sensor measures the air mass flow of the fresh air fed into intake duct 6, and generates a signal LM as a function thereof. Lambda sensor 13 measures the oxygen content of the exhaust gas in exhaust duct 7, and generates a signal $\lambda$ as a function thereof.

In a first operating mode (e.g., a stratified mode) of internal combustion engine 1, fuel is injected by injection valve 8, during a compression phase brought about by piston 2, into combustion chamber 4, physically into the immediate vicinity of spark plug 9 and temporally immediately before the top dead-center point of piston 2. The fuel is then ignited with the aid of spark plug 9 so that in the working phase which then follows, piston 2 is driven by the expansion of the ignited fuel.

In a second operating mode (e.g., a homogeneous mode) of internal combustion engine 1, fuel is injected by injection valve 8 into combustion chamber 4 during an intake phase brought about by piston 2. The injected fuel flows in turbulent fashion because of the air being simultaneously taken in, and is thus distributed substantially uniformly in combustion chamber 4. The fuel/air mixture is then compressed during the compression phase and is then ignited by spark plug 9. Piston 2 is driven by the expansion of the ignited fuel.

In both stratified mode and homogeneous mode, the driven piston imparts to a crankshaft 14 a rotation which ultimately causes the wheels of the motor vehicle to be driven. Associated with crankshaft 14 is a rotation speed sensor 15 which generates a signal N as a function of the rotation of crankshaft 14.

The fuel mass injected into combustion chamber 4 in stratified mode and homogeneous mode is controlled and/or regulated by a control device 16, in particular in terms of low fuel consumption and/or low exhaust gas production. For this purpose, control device 16 is equipped with a microprocessor which has stored in a storage medium, in particular in a read-only memory, a program which is suitable for effecting the above described control and/or regulation.

Control device 16 is acted upon by input signals which represent operating variables of the internal combustion engine that are measured via sensors. For example, control device 16 is connected to air mass sensor 12, lambda sensor 13, and rotation speed sensor 15. Control device 16 is moreover connected to an accelerator pedal sensor 17 which generates a signal FP indicating the position of an accelerator pedal which can be actuated by the driver. Control device 16 generates output signals with which, via actuators, the behavior of the internal combustion engine can be influenced in accordance with the desired control and/or regulation system. For example, control device 16 is connected to injection valve 8, spark plug 9, and exhaust gas recirculation valve 11, and generates the signals necessary for their activation.

Control and/or regulation of the fuel mass injected into combustion chamber 4 is performed, in both operating modes, by control device 16, as a function of, among other a reference torque $M_{soll}$. This reference torque represents that torque which is to be delivered or generated by internal combustion engine 1. The reference torque to be delivered is calculated by control device 16 as a function of the torque demanded by the driver and of further torque demands of internal combustion engine 1. The torque demanded by the driver is determined from the position of accelerator pedal sensor 17, and other torque demands, for example those of a climate-control system, can be derived from corresponding changes in the rotation speed N of internal combustion engine 1.

The result of the control and/or regulation performed by control device 16 is that an actually delivered true torque $M_{ist}$ is substantially slaved to the calculated reference torque $M_{soll}$ to be delivered. True torque $M_{ist}$ thus corresponds substantially to reference torque $M_{soll}$.

Figure 2:
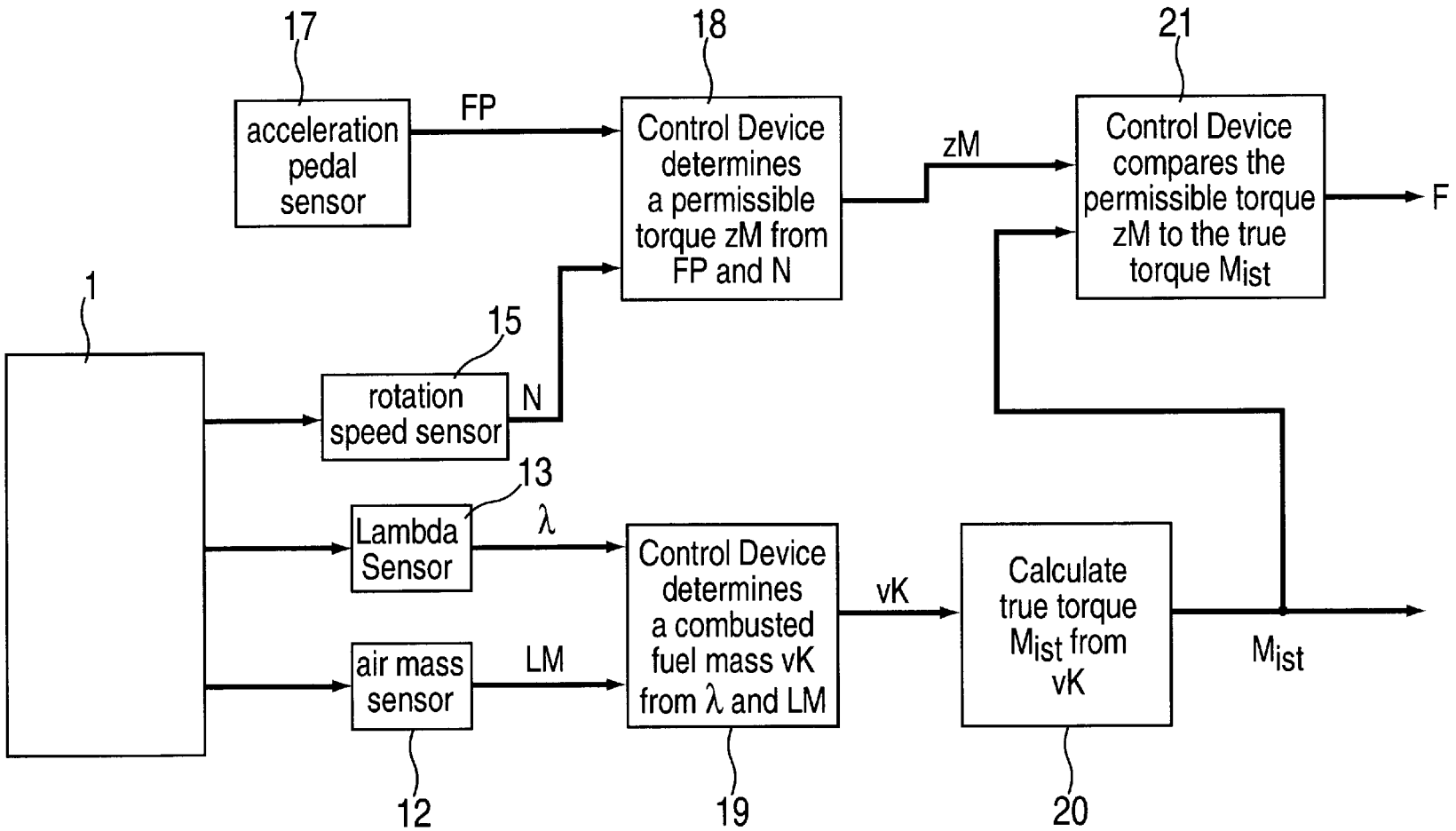
FIG. 2 shows a schematic block diagram of an exemplary embodiment of a method according to the present invention for operating the internal combustion engine illustrated in FIG. 1.

It is possible, however, that a fault may occur in the calculation made by control device 16 of the reference torque to be delivered. FIG. 2 shows a method with which a fault of this kind can be detected. The method is carried out by control device 16. It is possible in this case for the method, in particular, to be started regularly at specific time intervals and/or whenever internal combustion engine 1 is put into operation and/or upon the occurrence of other specific events during operation of internal combustion engine 1.

In a block 18, control device 16 determines, from the signal FP for the accelerator pedal position and from the rotation speed N of internal combustion engine 1, a permissible torque zM. This permissible torque zM is calculated by control device 16 in such a way that the torque demand of the driver and all other torque demands of internal combustion engine 1 are taken into consideration. It is also possible, in the calculation of the permissible torque zM, to allow a delta value which is added to the total torque requirements and takes into consideration any tolerances of sensors and the like.

In a block 19, control device 16 calculates, from the signal LM of air mass sensor 12 and the signal λ of lambda sensor 13, a combusted fuel mass vK from which the true torque $M_{ist}$ is then calculated by control device 16 in a block 20.

The combusted fuel mass vK is ultimately calculated by control device 16 via the combusted oxygen mass. This combusted oxygen mass in turn is calculated by control device 16 in block 19, from the fresh air fed into intake duct 6 and the oxygen which remains (and is therefore uncombusted) in the exhaust gas. The oxygen content of the fresh air fed into intake duct 6 is measured by air mass sensor 12 and can thus be taken into consideration by control device 16 via the signal LM. The oxygen content of the oxygen remaining in the exhaust gas is measured by lambda sensor 13, and can thus be taken into consideration by control device 16 via the signal λ.

From the signals LM and λ, control device 16 calculates the combusted fuel mass vK in block 19 using the following equation:

$$vK = \frac{mL}{k \cdot \lambda} + mAGR\left(\frac{1}{\lambda} - \frac{1}{\lambda}\right),$$

where:

vK=Combusted fuel mass mL=Air mass from signal LM mAGR=Recirculated exhaust gas mass k=14.8 for air/fuel ratio λ=1.

The first summands of the equation are used to calculate the combusted fuel mass vK from the air mass mL measured via signal LM, and from the signal λ which is a function of the oxygen concentration of the exhaust gas. This calculation refers to steady-state operation of internal combustion 1.

The second summand represents the oxygen storage capacity in the recirculated exhaust gas. Here λ' is the air/fuel ratio of the previous combustion event, and mAGR is a reference value. If the latter cannot be set, a fault exists and a corresponding fault reaction takes place. It is also possible to derive mAGR from measurements, for example from the pressure in intake duct 6 and the air mass flow there, or from the opening ratio of the throttle valve and of exhaust gas recirculation valve 11. The second summand refers to non-steady-state operation of internal combustion engine 1.

From the combusted fuel mass vK calculated in this fashion, control device 16 then derives, in block 20, the true torque $M_{ist}$ delivered by internal combustion engine 1. This true torque $M_{ist}$ is substantially proportional to the combusted fuel mass vK. The true torque $M_{ist}$ is the torque actually generated by internal combustion engine 1, including frictional losses. The true torque $M_{ist}$ can also be utilized for other calculations of control device 16.

In a block 21, control device 16 compares the permissible torque zM to the true torque $M_{ist}$ actually delivered by internal combustion engine 1, and on the basis of that comparison generates a signal F. If the true torque $M_{ist}$ is less than the permissible torque zM, the signal F is, for example, zero, while in the converse case, i.e. if the true torque $M_{ist}$ is greater than the permissible torque zM, the signal F is equal to 1.

If the true torque $M_{ist}$ is less than the permissible torque zM, this means that the value calculated by control device 16 for the reference torque $M_{soll}$ to be delivered, on which the actually delivered true torque $M_{ist}$ ultimately depends via the control or regulation performed by control device, at least lies in a plausible value range. Control device 16 can conclude therefrom that the calculation of the reference torque is at least not fundamentally wrong. No further actions are taken by control device 16 in this case.

If, however, the true torque $M_{ist}$ is greater than the permissible torque zM, this means that the value initially calculated by control device 16 for the reference torque to be delivered is too great, and thus contains a fault. The result of this fault is then that by way of the control or regulation performed by control 16, the actually delivered true torque $M_{ist}$ is also too great and thus exceeds the permissible torque zM. This fault is detected by control device 16 via the signal F=1.

Control device 16 thereupon starts a special function, for example a fault routine. With this fault routine, for example, parameters of internal combustion engine 1 which influence the actually delivered true torque $M_{ist}$ can be modified by control device 16 so as to reduce the true torque $M_{ist}$. It is also possible for the driver of the motor vehicle to be informed of the fault by the fault routine, via a corresponding indication. It is also possible for the fault routine to make a corresponding input into a memory, which is then read out by shop personnel when the motor vehicle is repaired or maintained, so as thereby to report the fault.

A minimum permissible torque can also be determined as a function of the accelerator pedal position. If the true torque $M_{ist}$ is lower than this minimum torque, and if the reference torque $M_{soll}$ is greater than the minimum torque, it can again be concluded from this that a fault exists, and corresponding actions can be initiated.

What is claimed is:

1. A method for operating an internal combustion engine, comprising the steps of:

in one of a first operating mode and a second operating mode, injecting a fuel mass directly into a combustion chamber, the first operating mode being during a compression phase, the second operating mode being during an intake phase;

calculating a reference torque to be provided by the internal combustion engine;

in the first and second operating modes, controlling the fuel mass injected into the combustion chamber as a function of the calculated reference torque;

determining an actual torque provided by the internal combustion engine, wherein the actual torque is determined as a function of at least one of the fuel mass which is combusted and a combusted oxygen mass;

determining a permissible torque; and comparing the actual torque with the permissible torque.

2. The method according to claim 1, further comprising the step of:

starting a predetermined procedure if the actual torque is greater than the permissible torque.

3. The method according to claim 1, wherein the actual torque is determined as a function of the fuel mass which is combusted.

4. The method according to claim 1, wherein the actual torque is determined as a function of the combusted oxygen mass.

5. The method according to claim 4, wherein the combusted oxygen mass is determined as a function of an infed fresh air and oxygen which remains in an exhaust gas of the internal combustion engine.

6. The method according to claim 5, further comprising the steps of:

measuring the infed fresh air by an air mass sensor; and measuring the oxygen remaining in the exhaust gas by a lambda sensor.

7. The method according to claim 4, wherein the combusted oxygen mass is determined as a function of a recirculation of an exhaust gas.

8. The method according to claim 1, wherein the permissible torque is determined as a function of a particular torque.

9. The method according to claim 8, further comprising the step of:

specifying the particular torque by a driver.

10. The method according to claim 9, wherein the permissible torque is determined as a function of a rotational speed of the internal combustion engine.

11. The method according to claim 10, further comprising the steps of:

measuring the particular torque by an accelerator pedal sensor; and measuring the rotational speed by a rotational speed sensor.

12. The method according to claim 1, wherein the internal combustion engine is contained in a motor vehicle.

13. The method according to claim 1, wherein the fuel mass which is combusted is determined based on an air mass, a recirculated exhaust gas mass, a first air/fuel ratio and a second air/fuel ratio.

14. The method according to claim 1, wherein the fuel mass which is combusted (vK) is determined based on an air mass (mL), a recirculated exhaust gas mass (mAGR), a first air/fuel ratio ($\lambda$), a second air/fuel ratio ($\lambda'$) and a constant (k), where:

$$vK=(mL/k+mAGR\cdot(1-\lambda/\lambda'))/\lambda.$$

15. The method according to claim 14, wherein k=14.8 for $\lambda=1$.

16. An electrical arrangement for a control device of an internal combustion engine, comprising:

a storage device storing a program, the program being executed by a calculation device to perform the following:

in one of a first operating mode and a second operating mode, injecting a fuel mass directly into a combustion chamber, the first operating mode being during a compression phase, the second operating mode being during an intake phase, calculating a reference torque to be provided by the internal combustion engine, in the first and second operating modes, controlling the fuel mass injected into the combustion chamber as a function of the calculated reference torque, determining an actual torque provided by the internal combustion engine, wherein the actual torque is determined as a function of at least one of the fuel mass which is combusted and a combusted oxygen mass, determining a permissible torque, and comparing the actual torque with the permissible torque.

17. The electrical arrangement according to claim 16, wherein the storage device includes a read-only memory device.

18. The electrical arrangement according to claim 16, wherein the internal combustion engine is contained in a motor vehicle.

19. The electrical arrangement according to claim 16, wherein the calculation device includes a microprocessor.

20. An internal combustion engine, comprising:

an injection valve injecting a fuel mass directly into a combustion chamber in one of a first operating mode and a second operating mode, the first operating mode being during a compression phase, the second operating mode being during an intake phase; and a control device calculating a reference torque to be provided by the internal combustion engine, the control device controlling the fuel mass injected into the combustion chamber in the first and second operating modes as a function of the calculated reference torque, wherein:

the control device determines an actual torque provided by the internal combustion engine and a permissible torque;

the actual torque is determined as a function of at least one of the fuel mass which is combusted and a combusted oxygen mass; and the control device compares the actual torque with the permissible torque.

21. The internal combustion engine according to claim 20, further comprising:

an air mass sensor communicating with the control device; and a lambda sensor communicating with the control device.

22. The internal combustion engine according to claim 20, further comprising:

an accelerator pedal sensor communicating with the control device; and a rotation speed sensor communicating with the control device.

23. The internal combustion engine according to claim 20, wherein the internal combustion engine is contained in a motor vehicle.

24. A method for operating an internal combustion engine, comprising the steps of:

in one of a first operating mode and a second operating mode, injecting a fuel mass directly into a combustion chamber, the first operating mode being during a compression phase, the second operating mode being during an intake phase;

calculating a reference torque to be provided by the internal combustion engine;

in the first and second operating modes, controlling the fuel mass injected into the combustion chamber as a function of the calculated reference torque;

determining an actual torque provided by the internal combustion engine;

determining a permissible torque;

comparing the actual torque with the permissible torque; and determining that a calculation of the reference torque is faulty based on at least one of a faulty control device, a faulty input variable for calculating the reference torque, a faulty sensor and a faulty software program of the control device;

wherein the actual torque is determined as a function of at least one of the fuel mass which is combusted and a combusted oxygen mass.

25. A method for operating an internal combustion engine, comprising the steps of:

in one of a first operating mode and a second operating mode, injecting a fuel mass directly into a combustion chamber, the first operating mode being during a compression phase, the second operating mode being during an intake phase;

calculating a reference torque to be provided by the internal combustion engine;

in the first and second operating modes, controlling the fuel mass injected into the combustion chamber as a function of the calculated reference torque;

determining an actual torque provided by the internal combustion engine;

determining a permissible torque;

comparing the actual torque with the permissible torque; and determining that a calculation of the reference torque is faulty based on at least one of a faulty control device, a faulty input variable for calculating the reference torque, a faulty sensor and a faulty software program of the control device;

wherein the actual torque is determined as a function of the fuel mass which is combusted.

26. A method for operating an internal combustion engine, comprising the steps of:

in one of a first operating mode and a second operating mode, injecting a fuel mass directly into a combustion chamber, the first operating mode being during a compression phase, the second operating mode being during an intake phase;

calculating a reference torque to be provided by the internal combustion engine;

in the first and second operating modes, controlling the fuel mass injected into the combustion chamber as a finction of the calculated reference torque;

determining an actual torque provided by the internal combustion engine;

determining a permissible torque;

comparing the actual torque with the permissible torque; and determining that a calculation of the reference torque is faulty based on at least one of a faulty control device, a faulty input variable for calculating the reference torque, a faulty sensor and a faulty software program of the control device;

wherein the actual torque is determined as a function of the combusted oxygen mass.

27. The method according to claim 26, wherein the combusted oxygen mass is determined as a function of an infed fresh air and oxygen which remains in an exhaust gas of the internal combustion engine.

28. The method according to claim 27, further comprising the steps of:

measuring the infed fresh air using an air mass sensor; and measuring the oxygen remaining in the exhaust gas using a lambda sensor.

29. The method according to claim 26, wherein the combusted oxygen mass is determined as a function of a recirculation of an exhaust gas.

30. A method for operating an internal combustion engine, comprising the steps of:

in one of a first operating mode and a second operating mode, injecting a fuel mass directly into a combustion chamber, the first operating mode being during a compression phase, the second operating mode being during an intake phase;

calculating a reference torque to be provided by the internal combustion engine;

in the first and second operating modes, controlling the fuel mass injected into the combustion chamber as a function of the calculated reference torque;

determining an actual torque provided by the internal combustion engine;

determining a permissible torque;

comparing the actual torque with the permissible torque; and determining that a calculation of the reference torque is faulty based on at least one of a faulty control device, a faulty input variable for calculating the reference torque, a faulty sensor and a faulty software program of the control device;

wherein the fuel mass which is combusted is determined based on an air mass, a recirculated exhaust gas mass, a first air/fuel ratio and a second air/fuel ratio.

31. A method for operating an internal combustion engine, comprising the steps of:

in one of a first operating mode and a second operating mode, injecting a fuel mass directly into a combustion chamber, the first operating mode being during a compression phase, the second operating mode being during an intake phase;

calculating a reference torque to be provided by the internal combustion engine;

in the first and second operating modes, controlling the fuel mass injected into the combustion chamber as a function of the calculated reference torque;

determining an actual torque provided by the internal combustion engine;

determining a permissible torque;

comparing the actual torque with the permissible torque; and determining that a calculation of the reference torque is faulty based on at least one of a faulty control device, a faulty input variable for calculating the reference torque, a faulty sensor and a faulty software program of the control device;

wherein the fuel mass which is combusted (vK) is determined based on an air mass (mL), a recirculated exhaust gas mass (mAGR), a first air/fuel ratio (λ), a second air/fuel ratio (λ') and a constant (k), where:

$$vK=(mL/k+mAGR\cdot(1-\lambda/\lambda'))/\lambda.$$

32. The method according to claim 31, wherein k=14.8 for λ=1.

* * * * *